US005848884A

United States Patent [19]

Haustein et al.

[11] Patent Number: 5,848,884

[45] Date of Patent: Dec. 15, 1998

[54] FLARE VENT IGNITION ASSEMBLY

[75] Inventors: Kevin Haustein; Tom O'Shea, both of Stettler, Canada

[73] Assignee: Judy O'Shea, Stettler, Canada

[21] Appl. No.: 713,218

[22] Filed: Sep. 12, 1996

[51] Int. Cl.[6] ..... F23D 00/00

[52] U.S. Cl. ..... 431/202; 431/258; 431/264

[58] Field of Search ..... 431/202, 80, 154, 431/155, 279, 258, 263, 264; 361/253, 247

[56] References Cited

U.S. PATENT DOCUMENTS

| | | | |
|---|---|---|---|
| 4,013,395 | 3/1977 | Wormser | 431/9 |
| 4,711,629 | 12/1987 | Macdonald | 431/264 |
| 4,854,855 | 8/1989 | Rajewski | 431/202 |
| 5,291,367 | 3/1994 | Rajewski | 361/253 |

FOREIGN PATENT DOCUMENTS

| | | | |
|---|---|---|---|
| 763761 | 7/1967 | Canada | 158/90 |
| 781249 | 3/1968 | Canada | 158/82 |
| 929847 | 7/1973 | Canada | 158/15 |
| 1054508 | 5/1979 | Canada | 158/8 |
| 1089662 | 11/1980 | Canada | 158/8 |
| 1288965 | 9/1991 | Canada | 67/37 |
| 2054810 | 11/1991 | Canada . | |
| 2125634 | 6/1994 | Canada . | |
| 2448692 | 10/1980 | France | 431/202 |

OTHER PUBLICATIONS

Mactronic Solar Charged Flare Ignition Systems for Remote Offschore Service (2 page brochure.

Tornado Pilot Monitoring and Relite System Model:TP-MR–A (110V DTT–23) (5page brochure).

Tornado Retractable Arch Light Models:TEIS–CS12,C24, C110, e/w CDS–9324/lgs Control Card (5 page brochure).

Tornado Flare Ignitor (Propane) Model: TSI #3 (7 page brochure).

Operating and Maintenance Manual for the Tornado Flare Stack Ignitor Model TSI#6 (5 pages).

Tornado Burner Tube Pilot Model TBTP #6 (Fuel Gas) C/W Peizo Push Button Ignition General Arrangement (3 page brochure).

Tornado Flare Systems: Arch Light Electronic Ignitors (6 page brochure).

Tornado Flare Systems Flare Tips (1 page).

The Tornado Flame Torpedo (1 page).

Tornado Flare Systems Freezing and Plugging Prevention (1 page).

Tornado Flare Systems Ceramic Pilot Nozzle (1 page).

Tornado Flare Systems Smokeless Flare Tips (1 page).

Tornado Flare Systems Enhanced Burn Unit (1 page).

Tornado Flare Systems Stays Lit Ceramic Burner Tube Pilots and Ignition Options (1 page).

TornadoFlare Systems Burner Assembly (1 page).

Company Capabilities, Products and Services (Tornado Flare Systems) (4 page brochure).

*Primary Examiner*—James C. Yeung
*Attorney, Agent, or Firm*—Thomas E. Malyszko

[57] ABSTRACT

In an ignition assembly for a flare vent having an open terminal end for venting waste gases, a hollow tubular stripper is located adjacent a generally upright exterior wall of the flare vent and has a lower opening and an upper opening proximate to the terminal end of the flare vent. A conduit for diverting some of the waste gases from the flare vent to the stripper is located below both the upper opening of the stripper and the terminal end of the flare vent. A pilot has an ignition end to ignite the diverted waste gases in the stripper to produce an ignition flame at the upper opening of the stripper, which in turn ignites the waste gases exiting the terminal end of the flare vent. The pilot is housed in a sleeve having an open first end for receiving the pilot and an open second end for exposing the ignition end of the pilot to the waste gases in the stripper. The sleeve is insertable into the stripper and, when inserted, allows air flow through the stripper to produce the ignition flame and to cool the sleeve. A track is attached to the exterior wall of the flare vent for moving the sleeve and pilot between an inoperative position near the base of the flare vent and an operative position near the terminal end of the flare vent. In the operative position the second end of the sleeve and the pilot are located within the stripper below the stream of waste gas entering the stripper through the conduit.

31 Claims, 9 Drawing Sheets

FLARE VENT IGNITION ASSEMBLY

FIELD OF THE INVENTION

The present invention relates to an ignition assembly for flare vents used in the oil and gas producing industry, in particular for flare stacks, flare pits and burner tubes.

BACKGROUND OF THE INVENTION

Oil pumped to the earth's surface at oil wells gives off associated or waste gases (such as sour gas) which must be burned off for environmental purposes. Typically these waste gases are sent up a tall flare vent (eg. a flare stack) which can reach heights of 300 feet (about 90 meters) or more to keep the large flare or flame atop the stack a safe distance above ground level. The flare must be kept burning to avoid the release of the raw waste gases into the atmosphere. It is not uncommon for the flare to be extinguished due to wind conditions and interruptions of waste gas flow up the stack. Hence, an ignition assembly is normally provided to re-ignite the flare.

Ignition assemblies generally utilize one of two types of pilots to reignite a flare, namely a flame-type pilot which produces a fuel-fed flame (referred herein as a "pilot flame"), and an electrode-type pilot which produces electrical arcs or "sparking". Such prior art pilots are typically located at the open terminal end of the flare stack right in or beside the stream of waste gases traveling up the stack. Although such arrangements ensure that the pilot is exposed to the waste gas stream for ignition purposes, there are several resultant drawbacks.

One disadvantage of these prior pilots is that such direct and continuous exposure to the corrosive elements in the waste gases causes relatively rapid or premature corrosion of the pilot, even though it may be constructed of corrosion resistant materials such as stainless steel. Another disadvantage is the pilot's close proximity and resultant exposure to the intense heat of the flare atop the stack, which can reach temperatures in excess of 1800 degrees F. (about 1000 degrees C.). Such elevated temperatures accelerate degradation of the pilot. As a result, prior art pilots require frequent maintenance, repair and replacement, which adds significantly to the operating costs of a flare stack.

Prior art flame-type pilots suffer from other drawbacks or inefficiencies as well. They tend to consume relatively large amounts of fuel (such as propane) and require high fuel pressures to produce and maintain the pilot flame. These pilots typically consume 3 to 6 liters or more of fuel per day and run on 12 to 18 psi pressure, depending on particular circumstances. Hence, operating costs (apart from maintenance) can be expensive as well.

What is desired therefore is an ignition assembly which overcomes the limitations and disadvantages of these other prior art devices. Preferably the assembly should be located away from the open top of the flare stack to avoid exposing the pilot to the elevated temperatures of the flare atop the flare vent, and in addition should have a means to help cool the pilot. Further, the pilot should not be directly exposed to the flow of the corrosive waste gases in the stack. The ignition assembly should also be relatively fuel efficient and function on relatively low fuel pressures to further reduce operating costs.

SUMMARY OF THE INVENTION

In one aspect the present invention provides an ignition assembly for a flare vent having an open terminal end for venting waste gases comprising:

a stripper comprising a generally hollow tubular member located adjacent a generally upright exterior wall of said flare vent, said tubular member having a lower opening and an upper opening proximate to said terminal end of the flare vent;

a conduit for waste gas communication from said flare vent to said stripper, said conduit being located below both said upper opening of the stripper and said terminal end of the flare vent;

a pilot having an igniting end for igniting waste gases entering said stripper through said conduit to produce an ignition flame at said upper opening of the stripper, said ignition flame igniting waste gases exiting said terminal end of the flare vent;

an elongate tubular housing for said pilot having an open first end for exposing said pilot igniting end to waste gases in the stripper, wherein said housing is insertable into said stripper and when inserted allows air flow through said stripper for producing said ignition flame and for cooling said first end of the housing; and a track attached to said exterior wall of the flare vent for moving said housing and pilot between an inoperative position near the base of said flare vent and an operative position near said terminal end of the flare vent, wherein in said operative position said first end of the housing and said pilot are located within said stripper below said conduit.

In another aspect the invention provides an ignition assembly for an upright flare vent having an open terminal end for venting waste gases comprising:

a generally elongate pilot having an igniting end;

a generally elongate sleeve housing said pilot, said sleeve having an open first end for exposing said igniting end to the ambient;

a hollow stripper mounted adjacent an exterior wall of said flare vent, said stripper having opposed upper and lower openings, said upper opening being located adjacent said terminal end of the flare vent;

a conduit located below both said upper opening of the stripper and said terminal end of the flare vent for diverting a portion of said waste gases from said flare vent into said stripper, said diverted gases forming a stream upon exiting said conduit in said stripper;

a track attached to said exterior wall of the flare vent for locating said igniting end of the pilot and said first end of the sleeve in said stripper in close proximity to said stream of waste gases from the conduit.

DESCRIPTION OF THE DRAWINGS

Embodiments of the invention will now be described, by way of example only, with reference to the accompanying drawings, wherein.

DESCRIPTION OF PREFERRED EMBODIMENTS

Figures 1, 2, 3:
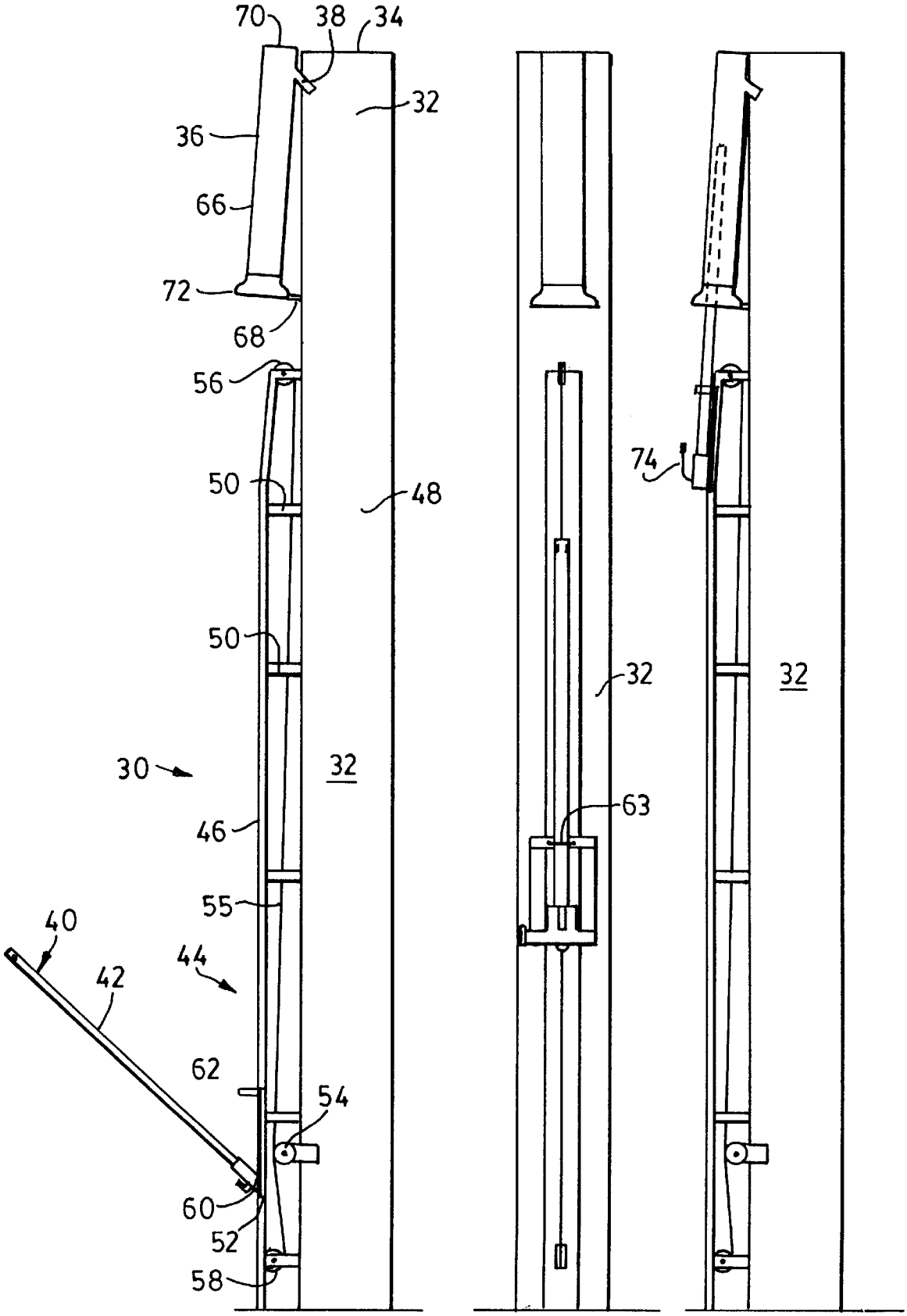
FIG. 1 is an elevated side view of an upright flare stack carrying an ignition assembly in an inoperative position according to a first, preferred embodiment of the present invention.
FIG. 2 shows the ignition assembly of FIG. 1 in an operative position.
FIG. 3 is an elevated front view of the ignition assembly of FIG. 1 between the operative and inoperative positions.

Reference is first made to FIGS. 1 to 3 which show an ignition assembly according to a first embodiment of the invention (generally indicated by reference numeral 30) mounted to a generally vertical or upright flare stack 32 commonly used in the oil and gas industry to vent and burn off unwanted gaseous by-products, also known as associated gases or waste gases, such as sour gas, through an open terminal end 34. Although the invention may be used with other types of flare vents such as flare pits and burner tubes, a flare stack is used for illustrative purposes.

The ignition assembly 30 has several elements, including a stripper 36 with a conduit 38, and a pilot 40 located in a sleeve or housing 42 which travels on a track system 44 operated by a technician or other user. There are two alternate types of pilot in the present invention. A first pilot type (FIGS. 1–18), referred to as a "flame pilot", operates on a fuel, like propane or natural gas, to produce a flame (referred to later as a "primary flame" or a "pilot flame") for igniting gases entering the stripper 36 through conduit 38. A second pilot type (FIGS. 19–25) uses an electrode to produce sparks for igniting those same gases in the stripper 36, and will be referred to as a "sparking pilot". The ignition assembly 30 having the flame pilot comes in three versions. A first version (FIGS. 1–10) is called a "manual light" because the pilot flame must be lit manually by a technician upon being extinguished. A second version (FIGS. 11–14), called an "auto-light", incorporates an electrode assembly to determine when ignition current or sparks at a preset voltage, duration and time interval (for example, one second of sparking at 20,000 V every other second) are needed to re-light the pilot flame automatically should it be extinguished. Lastly, a third version of the flame pilot (FIGS. 15–18), called a "sensored auto-light", is similar to the auto-light version except that a temperature sensitive thermocouple assembly is employed to turn the electrode assembly on and off when the pilot flame is on or extinguished, respectively. The thermocouple assembly may also be used with the "sparking pilot", if desired. The above embodiments of the present invention will now be described in greater detail below.

The track 44 is common to all embodiments of the invention. Referring to FIGS. 1–3, and particularly to FIGS. 4*a*–4*c,* the track 44 has an elongate u-shaped channel or rail 46 extending generally parallel to the stack 32. The channel 46 is mounted onto a generally cylindrical exterior wall 48 of the stack 32 by a number of support brackets 50 distributed along the length of the channel. A carrier 52 for carrying the pilot 40 and pilot housing 42 is slideably mounted on the channel 46 using one or more c-shaped brackets 53 (preferably two), and may be moved along the channel using a motorized or hand operated winch 54 (FIG. 1) which engages a continuous cable 55 running around upper and lower pulleys 56 and 58, respectively, located at each end of the channel 46. The winch also keeps the cable 55 taut. Stops (not shown) are provided on the channel 46 to limit sliding of the carrier 52 between a fully lowered, inoperative position (FIG. 1) and a fully raised, operative position (FIG. 2). A pair of spaced lower arms 60 on the carrier 52 pivotally connect the bottom end of the pilot housing 42 to the carrier, and a pair of spaced upper arms 62 detachably connect an intermediate portion of the housing 42 to the carrier in a generally vertical orientation by inserting pin 63 through aligned holes 64 when the housing is located between the upper arms 62.

Figure 4A:
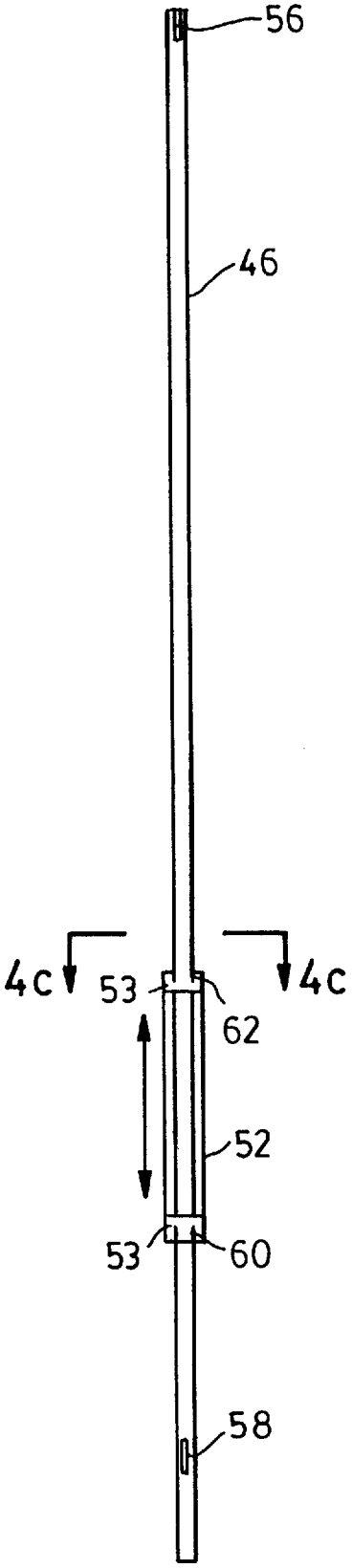
FIG. 4*a* is an enlarged front view of a track of FIG. 1.
Figure 4B:
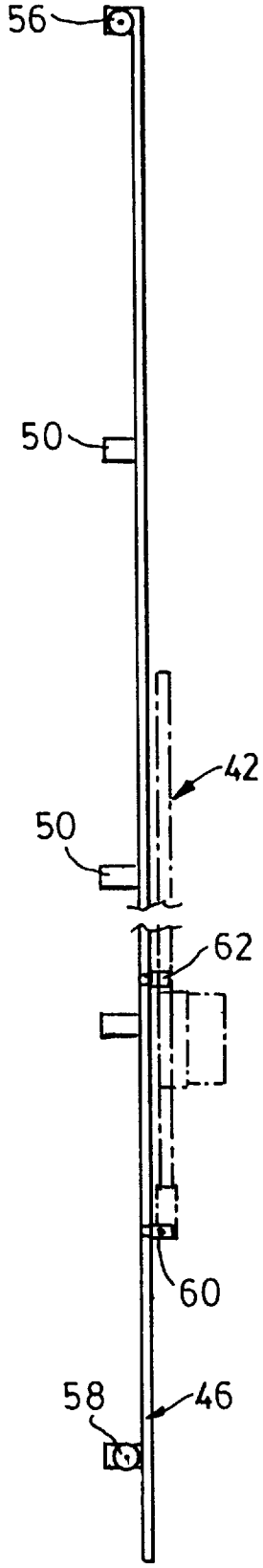
FIG. 4*b* is a side view of the track of FIG. 4*a;*
Figure 4C:
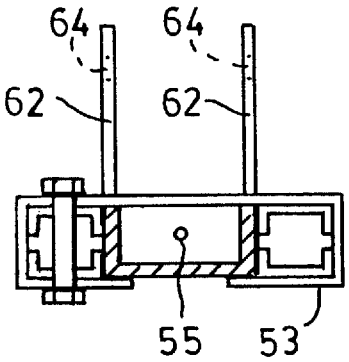
FIG. 4*c* is a sectional view taken on line 4*c*—4*c* of FIG. 4*a;*

An advantage of the track 44 is that the pilot housing 42 may be easily lowered from the operative position to the inoperative position and conveniently swung away from the stack 32 (as shown in FIG. 1) for maintenance, repairs or the like. Returning the pilot housing 42 to the operative position is likewise convenient. Using channel iron for the track also offers several advantages: the pulley cable 55 and other cables hanging down (not shown) from the pilot housing in the operative position may be neatly hidden within the u-shaped channel 46 (as indicated in FIG. 4*c*) and pinned therein to prevent them from flailing in the wind and causing damage, and so the track (ie. channel) may be mounted closer to the stack than prior art tracks; and, mounting of the pulleys 56, 58 onto the channel 46 is easier than onto prior art tracks. It is also noted that the upper portion of the channel 46 is inclined toward the flare stack 32 to facilitate insertion of the pilot housing 42 into the stripper 36 and to tip the upper end of the pilot housing toward the conduit 38 as discussed later.

Still referring to FIGS. 1–3, an important feature of the invention is the stripper 36 present in all embodiments. The stripper 36 provides a means for the pilot 40 to in effect ignite the gases escaping the flare stack 32 from a location remote from the terminal end 34 of the stack. Hence, as discussed later, the pilot 40 is not subjected to the same intense heat and direct flow of stack gases were it located right by the terminal end 34. The stripper also acts as a wind shroud for the pilot.

The stripper 36 is in the form of a hollow cylindrical shell or tube 66 located adjacent the exterior wall 48 of the flare stack 32 and attached thereto by a bracket 68 and conduit 38. An upper opening 70 of the tube 66 is located at about the same level as, or proximate to, the terminal end 34 of the flare stack, and a lower opening 72 is flared outwardly to help guide the pilot housing 42 into the stripper 36 when being lifted therein. The stripper is inclined toward the flare stack 32 to locate the upper end of the tube 66 closer to the stack 32 than the lower end. In the operative position the tip of the pilot housing 42 is located at about the same level as or preferably just below the entrance of the conduit 38 into the stripper 36 (by about 2 inches in the preferred embodiment). Since the stripper 36 is typically spaced closer to the stack 32 than the track 44, the upper portion of the track 44 is also inclined to place the pilot housing 42 generally parallel to or in line with the tube 66 in the operative position. In addition, the tube 66 has a larger circumference than the pilot housing 42 to allow upward air flow through the stripper between the tube and the pilot housing. Good results have been had with a 4 foot (aprox. 122 cm) tall stripper made of stainless steel tubing having an inside diameter of between 2 to 3 inches (aprox. 51 to 76 mm). Although a shorter stripper may be used, it is desireable to keep the stripper relatively tall to space the lower opening 72 a good distance away from the stack's terminal end 34 where the hot flare is burning, thus avoiding drawing in heated air from the flare area into the lower opening 72 and instead allowing relatively cooler air to be sucked in for cooling purposes discussed below.

The hollow conduit 38 penetrates the sides of the tube 66 and the flare stack 32 below the upper opening 70 and the open terminal end 34, respectively. In the preferred embodiment, the conduit 38 is about 2 inches (aprox. 51 mm) long, has a 0.5 inch (aprox. 12.7 mm) inside diameter, penetrates the stripper about 4 inches (aprox. 100 mm) below the upper opening 70, and is cut flush with the inside surface of the stripper tube 66. The conduit 38 provides a passage through which a portion of the gases moving up the flare stack 32 may flow into the stripper 36 for ignition by the pilot 40 to produce an ignition or secondary flame in the vicinity of the upper opening 70. The ignition flame in turn ignites the gases exiting the terminal end 34 of the flare stack. To facilitate the flow of gases through the conduit 38, the conduit is inclined upwardly from the flare stack to the stripper and extends slightly into the flare stack 32 as shown. An angle of about 45 degrees from the horizontal has produced good results because it brings gases into the stripper while directing the flow above the tip of the pilot housing 42 rather than directly onto the tip, which helps avoid corrosion of the ignition assembly, particularly the pilot housing. Combustion of the ignition flame is aided by air drawn through the stripper from the lower opening 72 to provide for a relatively clean burn. This flow or current of relatively cooler air from the bottom of the stripper also helps cool the pilot housing 42 and the pilot within.

As noted above, the stripper 36 accommodates both flame and sparking pilots. Reference is now made to the flame pilot. FIGS. 1–8, but in particular in FIGS. 5–8, show the flame pilot 40 of the first embodiment of the invention which must be lit manually by a technician (ie. the "manual light" version). Referring to FIG. 8, the pilot 40 operates on fuel supplied from a fuel source (not shown), typically through a flexible high pressure hose 74 connected to the pilot's fuel line 74 via an elbow connection 76 having a fuel filter 77. The fuel line 78 communicates with a conventional venturi orifice 80 for introducing air to the supplied fuel. The air and fuel then pass from the venturi 80 to a tube 83 forming a mixing chamber 82 of sufficient length to provide adequate mixture of the air and fuel. In the first embodiment, the tube 83 is made of 0.5 inch (aprox. 12.7 mm) diameter standard tubing, and the mixing chamber 82 within extends about 60 inches (aprox. 1524 mm) in length. However, good results have been achieved with a mixing chamber as short as 1 foot (aprox. 305 mm). The mixing chamber may also be longer than 60 inches, as might be used for pit igniters.

Figure 10:
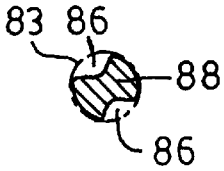
FIG. 10 is a plan view taken along the line 10—10 of FIG. 9 of the flame spreader.
Figure 9:
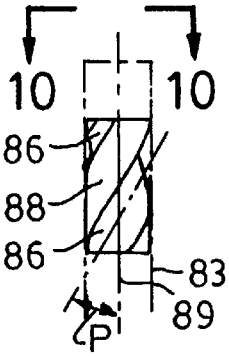
FIG. 9 is a close-up sectional view of a top portion of the pilot of FIG. 8 showing a flame spreader embedded therein.

The air/fuel mixture then passes from the mixing chamber 82 through a flame spreader 84 located in a continuation of the same tube 83 which forms the mixing chamber 82, shown in detail in FIGS. 9 and 10. The construction of the flame spreader 84 is akin to a potion of a drill bit where one or more channels 86 wind around a solid core or hub 88. A spiral or twisting motion is imposed on the air/gas stream as it passes through the channels 86 and exits into a combustion chamber 90 immediately above the flame spreader. The flame spreader not only further mixes the air/gas stream for better combustion but helps provide a back pressure in the mixing chamber 82 which helps propel the air/gas mixture into the combustion chamber. In the FIG. 9 embodiment there are two helical u-shaped channels 86 about the core 88 Optimal results have been achieved using a flame spreader with an incline or angle "P" (as measured to the longitudinal axis 89 of the core 88) of about 30 degrees and a length L of about 1 inch (aprox. 25 mm). However, small variations of these configurations have also produced acceptable results, namely a pitch of between about 25 and 35 degrees and a length L of between 0.75 and 1.25 inches (aprox. 19 to 32 mm, respectively). The pitch should not exceed 35 degrees. The flame spreader 84 is seated about 1 inch (aprox 25 mm) below the tip of tube 83. This space above the flame spreader forms the combustion chamber 90 for combustion of the air/fuel exiting the flame spreader, which produces the pilot or primary flame. In operation, the pilot flame ignites the gases entering the stripper 36 through the conduit 38 to produce the ignition or secondary flame mentioned earlier.

Figure 5:
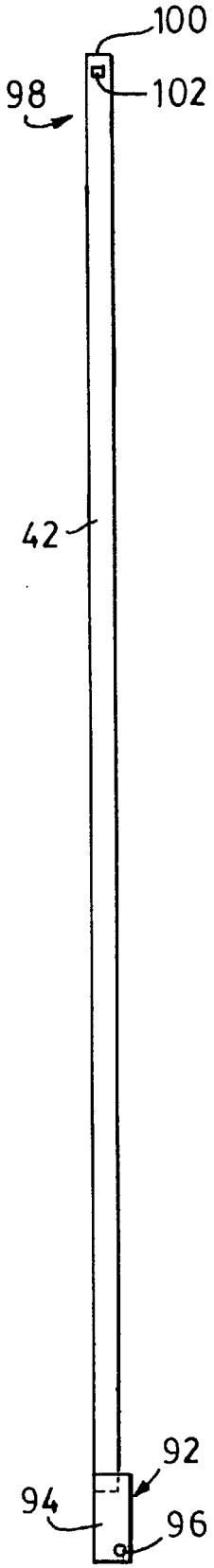
FIG. 5 is an elevated side view of a pilot housing of the ignition assembly of FIG. 1.
Figure 6:
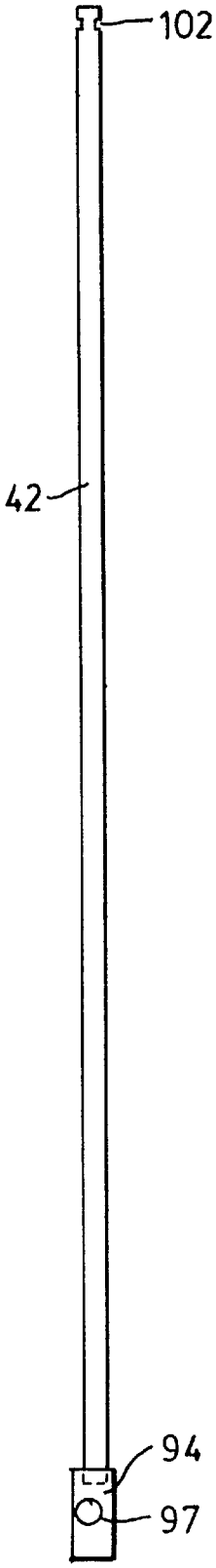
FIG. 6 shows the pilot housing of FIG. 5 rotated 90 degrees counterclockwise.
Figure 7A:
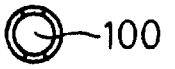
FIG. 7 is a close-up view, partially broken away, of a top potion of the pilot housing of FIG. 6.
Figure 7:
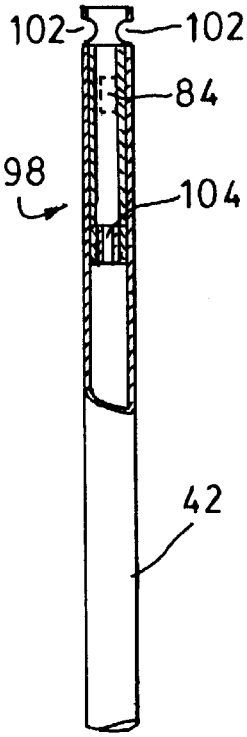
Figure 8:
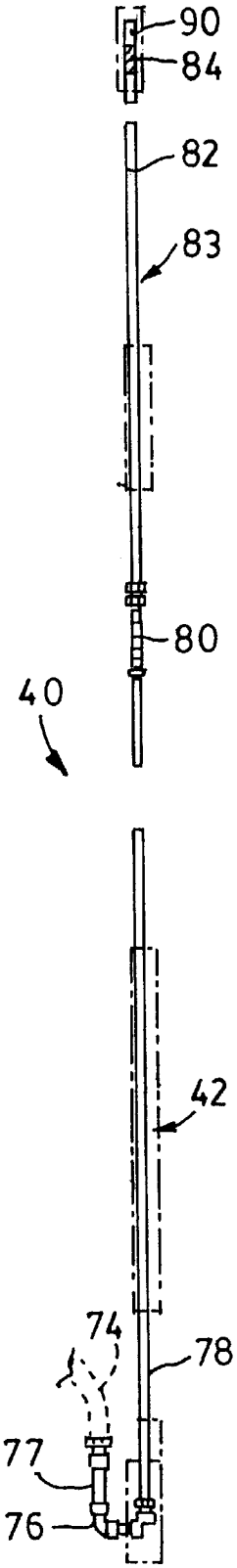
FIG. 8 is a side view of a pilot of the ignition assembly of FIG. 1 with portions of the pilot housing shown in ghost outline.
Figure 11:
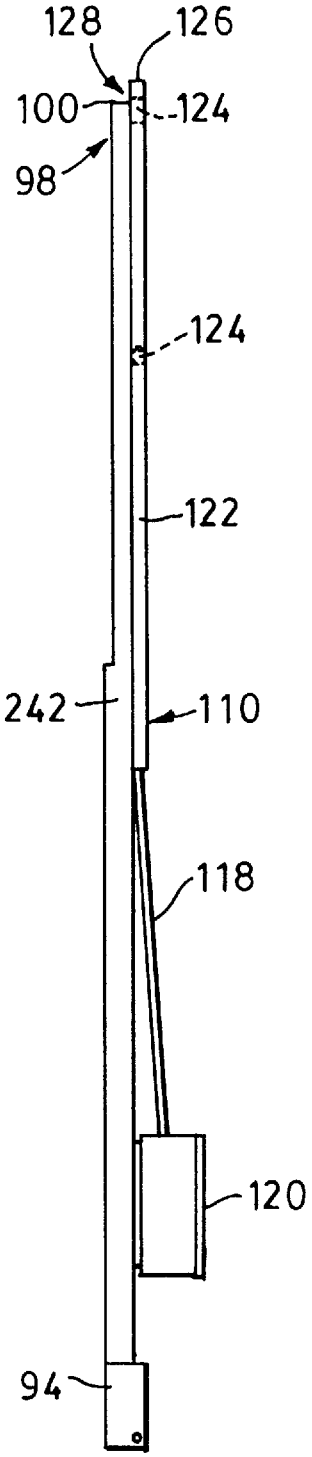
FIG. 11 is an elevated side view of a second embodiment of the ignition assembly showing an electrode assembly attached to the pilot housing.
Figure 12:
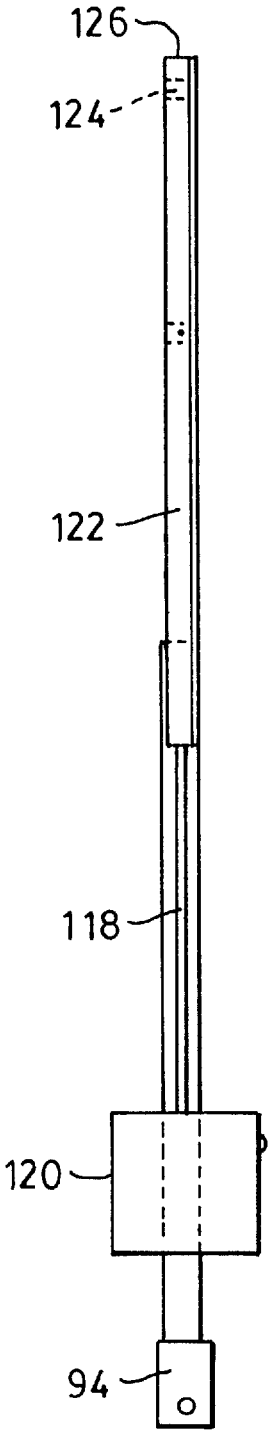
FIG. 12 shows the electrode assembly and pilot housing of FIG. 11 rotated 90 degrees clockwise.
Figure 14:
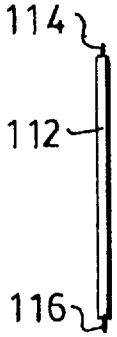
FIG. 14 is an isolated view of an electrode of the electrode assembly of FIG. 13.
Figure 13:
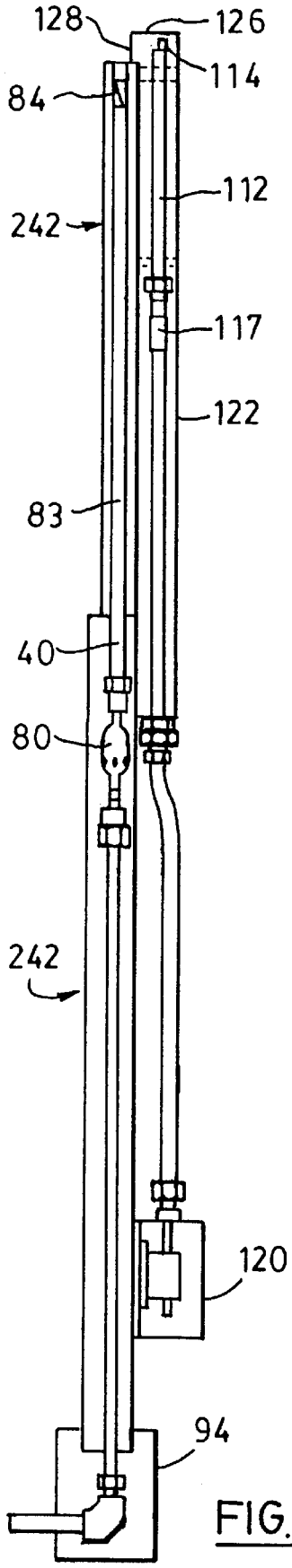
FIG. 13 is a transparent view of the pilot housing and electrode assembly of FIG. 11.
Figure 15:
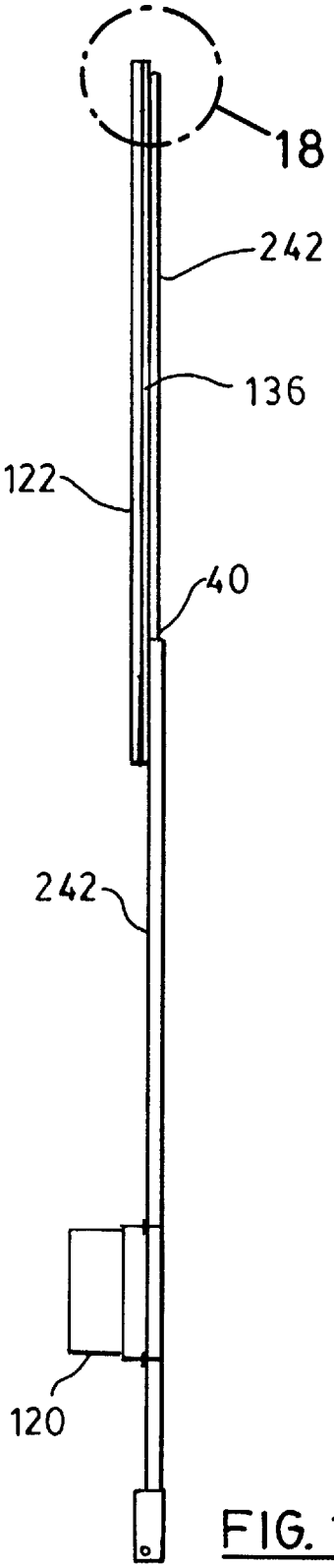
FIG. 15 is an elevated side view of a third embodiment of the ignition assembly showing portions of an electrode assembly and a thermocouple assembly attached to a pilot housing.

The pilot 40 is located within the pilot housing 42 shown partly in ghost outline in FIG. 8 and in more detail in FIGS. 5, 6 and 7. The housing 42 comprises an elongate pipe made of stainless steel or other suitable corrosion resistant material and has an open first end 92 for insertion of the pilot 40 therein. Box-like tubing 94 is fixed to the first end 92 and has apertures 96 to pivotally mount the housing 42 to the lower arm 60 of the track carrier 52 using a pin or other conventional means. A larger hole 97 on an adjacent face of tubing 96 (and located closer to the first end 92 than the apertures 96) accommodates a portion of the elbow connection 76 of the pilot 40. A second end 98 of the housing has an opening 100 (see FIG. 7) for exposing the pilot flame to the stripper 36. Two opposed slots 102 are provided to permit the pilot flame to spread sideways.

Several bushings inside the housing (one of which is indicated by 104 in FIG. 7) centre the pilot in the housing. The pilot and housing are sized for air flow at least between the open first end 92 and the venturi 80 to permit the previously noted mixing of air and fuel to take place. The venturi 80 is kept a considerable distance away from the first opening 92 to reduce the risk of dirt and debris reaching the venturi 80. In the FIG. 8 embodiment the venturi 80 is about 55 inches (aprox. 1400 mm) from the opening 92, namely about the length of the pilot fuel line 78. Such spacing also has the added benefit of keeping the flexible fuel hose 74 as far away as possible from the heat of the flame atop the flare stack. The length of the housing 42 is also influenced by the location of the pilot's combustion chamber 90 within the housing. The combustion chamber 90 should sit right below the two housing slots 102, namely the tip of tube 83 should just meet the bottom of the open slots 102 so that the pilot flame may spread sideways as noted above. As a result, the flame spreader 84 is located close to the slots 102, namely about 1 inch (aprox. 25 mm) below, as indicated in ghost outline in FIG. 7.

The second embodiment of the invention, namely the "auto-light" version shown in FIGS. 11–14, essentially employs the same pilot 40 as in the first embodiment, but in addition the ignition assembly incorporates an electrode assembly 110. Like reference numbers are used for features common to the first embodiment. The electrode assembly employs a conventional ceramic electrode 112 (FIG. 14) having a spark producing tip 114 and an opposed tip 116 connected (using a spark plug type connector 117) to a source of electric power (not shown) via an electric cable 118 and a coil box 120. The electrode 112 is mounted in casing 122 using two slit bushings 124 with set screws, and the open bottom of the casing is accessible to the cable 118. The casing 122, a 0.75 inch (aprox. 19 mm) diameter pipe in this embodiment, is mounted beside the pilot housing 242. Housing 242 differs from housing 42 of the first embodiment only in that the outside diameter or size of housing 242 is reduced from about 1 inch to about 0.5 inch (aprox. 25 mm and 12.5 mm, respectively) above the venturi 80 to take up less space in the stripper 36 to help accommodate the casing 122 and still allow air flow through the stripper. A top portion 126 of the casing 122 forms a plate which is electrically grounded and which is spaced from the electrode tip 114 to form a spark gap across which sparks travel when an electric current is introduced to the tip 114. The top portion 126 extends above the open second end 98 of housing 242. Some of the casing 122 at the side 128 adjacent housing end 98 is cut away so that any air/fuel mixture rising from the pilot's combustion chamber 90 through opening 100 is exposed to the above noted sparks to ignite the mixture, thereby relighting the pilot flame.

Figure 18:
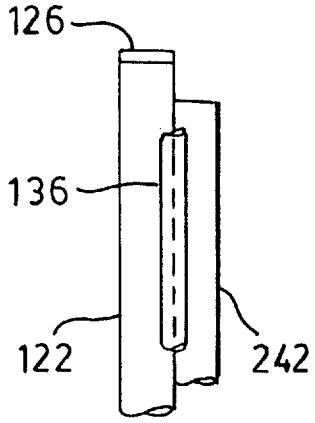
FIG. 18 is a close-up view of the circled area in FIG. 15, partly broken away.
Figure 16:
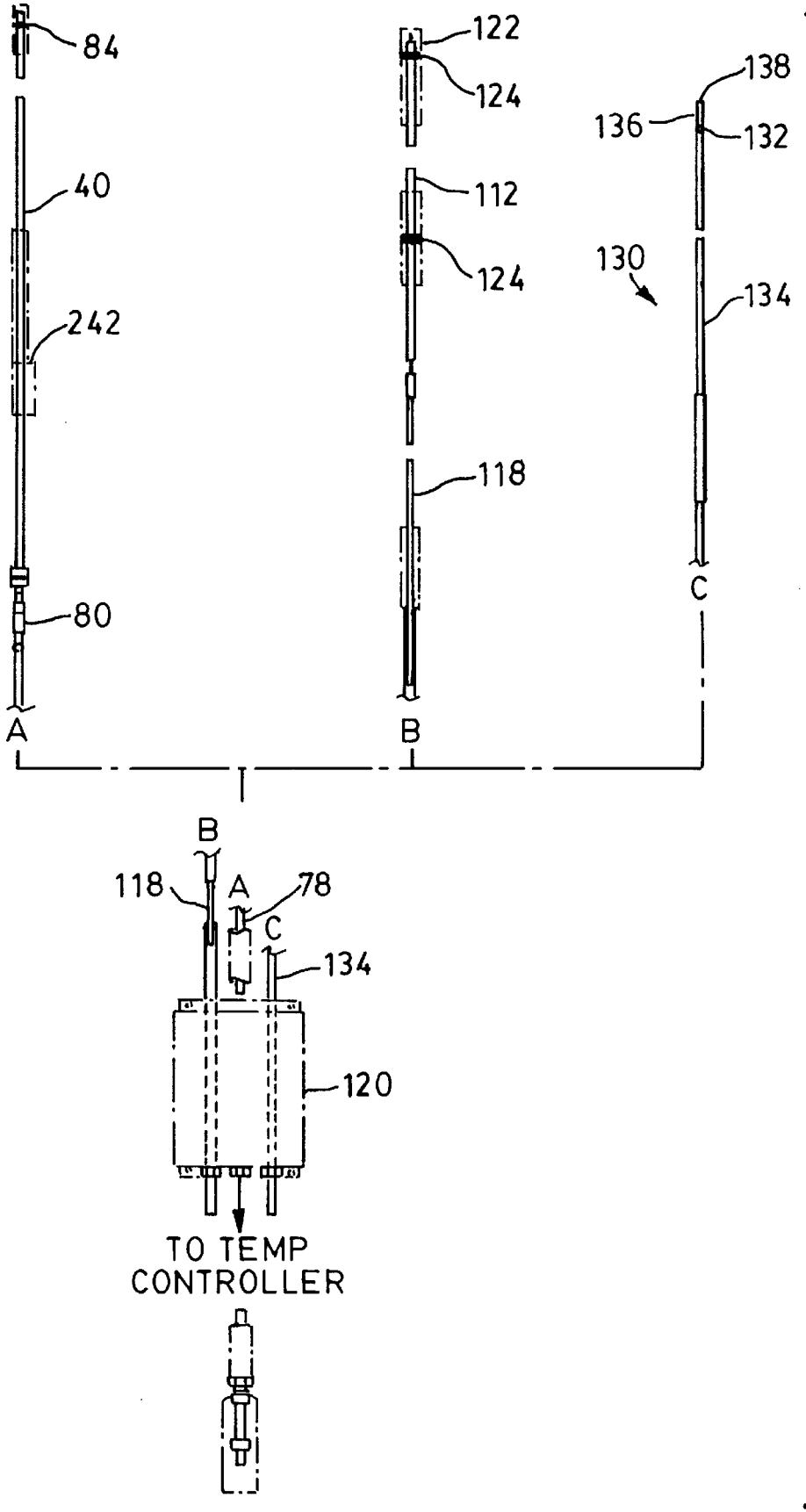
FIG. 16 is a schematic broken apart view of the ignition assembly of FIG. 15.
Figure 17:
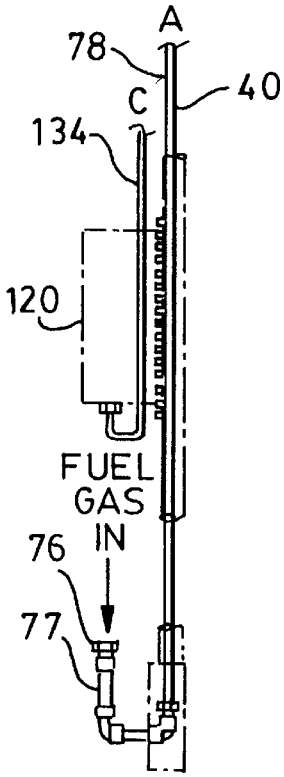
FIG. 17 is a close-up side view of a lower portion of the pilot and thermocouple assembly of FIG. 16.

In the third embodiment of the invention, namely the "sensored auto-light" version shown in FIGS. 15–18, the ignition assembly essentially has the same pilot 40 as in the first embodiment and the same electrode assembly 110 as in the second embodiment, but in addition incorporates a thermocouple assembly 130. Like reference numbers are used for features common to the first and second embodiments. The thermocouple assembly 130 employs a heat sensor or probe 132 connected by a data transmission line 134 to a coil box 220 which in turn communicates with a temperature controller (not shown) which analyses data received from the sensor 132. A stainless steel casing or chamber 136 for the sensor is located beside both the electrode casing 122 and the pilot housing 242 (FIG. 18). The upper end 138 of the sensor casing 136 is placed at the same elevation as the electrode casing 122 (FIG. 15), although unlike electrode casing 122 the sensor casing 136 is not cut out at the top but is completely enclosed to protect the sensor from the flame and corrosive gases. In operation, when the pilot flame is extinguished for some reason and the temperature at the sensor 132 falls below a pre-set value, say 212 degrees F. (aprox. 100 degrees C), the temperature controller activates the electrode assembly 110 to re-light the pilot 40. When the temperature then begins to again recover and exceeds the same or another higher pre-set value (say 300 degrees F., or about 150 degrees C.) the temperature controller shuts off the sparking at the electrode 112.

In a fourth embodiment of the invention shown in FIGS. 19–22, the sparking pilot 140 mentioned earlier is substituted for the flame pilot 40. Similarly to the flame pilot, the sparking pilot 140 has an elongate tubular housing 142 (FIGS. 19 and 20) with an open bottom end 144 for receiving a two-part electrode 146 (FIG. 22) therein. The pilot housing is mounted to the track 44 on the flare stack 32 the same way as pilot housing 42, for instance by fitting the housing's bottom end 144 with box-like tubing 148 (similar to 94) for pivotal connection to lower arm 60 of carrier 52. The pilot housing 142 is insertable into the stripper 36 with the housing's top end 150 located immediately below the mouth of conduit 38. The electrode 146 is connected to a coil box 152 which in turn communicates with a power source (not shown) by wire 154.

Figure 21A:
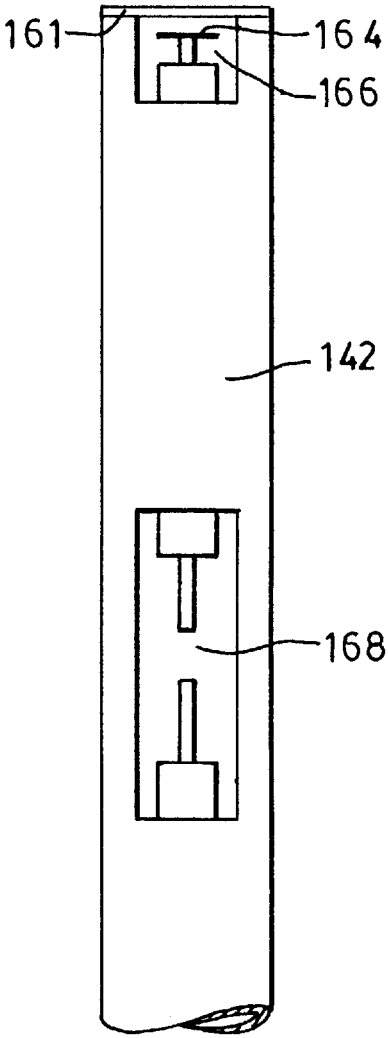
FIG. 21*a* is a close-up view of a top portion of the ignition assembly of FIG. 19.

Referring specifically to FIGS. 21*a,* 21*b* and 22, the electrode 146 comprises a ceramic upper part 146*a* and a ceramic lower part 146*b* having a bottom tip 156 which is wired to the coil box 152. The electrode forms two spark gaps, one between the opposed tips 158 and 159 of the upper and lower parts 146*a* and 146*b,* respectively, and the other gap between the top tip 160 of part 146*a* and the top end 150 of the housing 142. The housing's top end 150 forms a donut shaped disk 161 with an aperture 162, and the electrode tip 160 has a plate-like tip which is spaced from the disk 161 to form one of the spark gaps. The housing has an upper and lower set of spaced slots 166 and 168 which expose the above mentioned spark gaps to the gases which have entered the stripper through the conduit 38. When an electric current is supplied to the electrode 146 at tip 156, arcing takes place simultaneously across both gaps. This dual gap arrangement has been found to be advantageous where there are fluctuations of gas volumes in the stack, and hence in the stripper as well.

Figure 23:
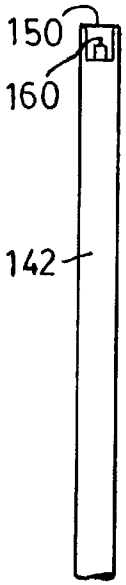
FIG. 23 is an alternate embodiment of the top portion of the ignition assembly of FIG. 19.
Figure 22:
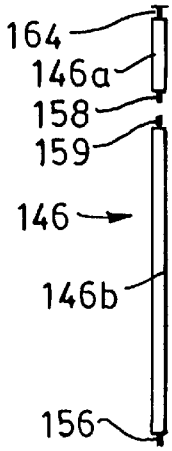
FIG. 22 is an isolated view of an electrode of the ignition assembly of FIG. 19.
Figure 19:
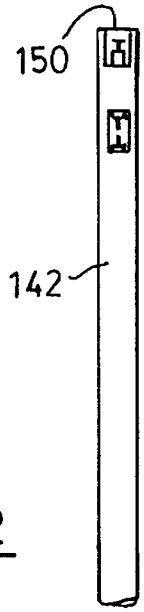
FIG. 19 is an elevated front view of a fourth embodiment of an ignition assembly according to the present invention.
Figure 19:
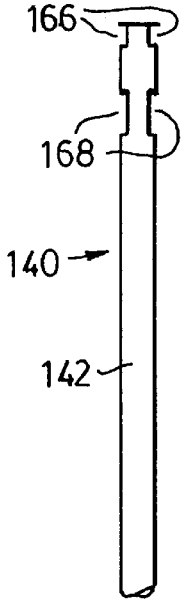
Figure 19:
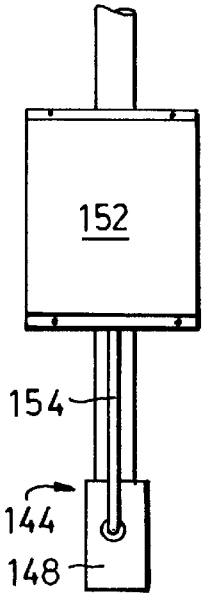
Figure 20:
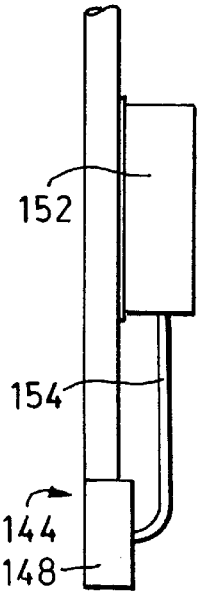
FIG. 20 shows the ignition assembly of FIG. 19 rotated 90 degrees clockwise.
Figure 24B:
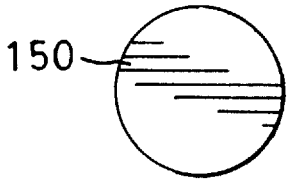
FIG. 24*b* is a plan view of FIG. 24*a;*.
Figure 21B:
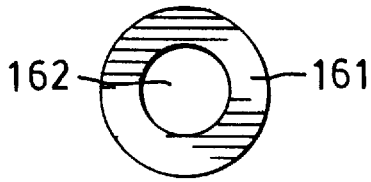
FIG. 21*b* is a plan view of FIG. 21*a;*
Figure 24A:
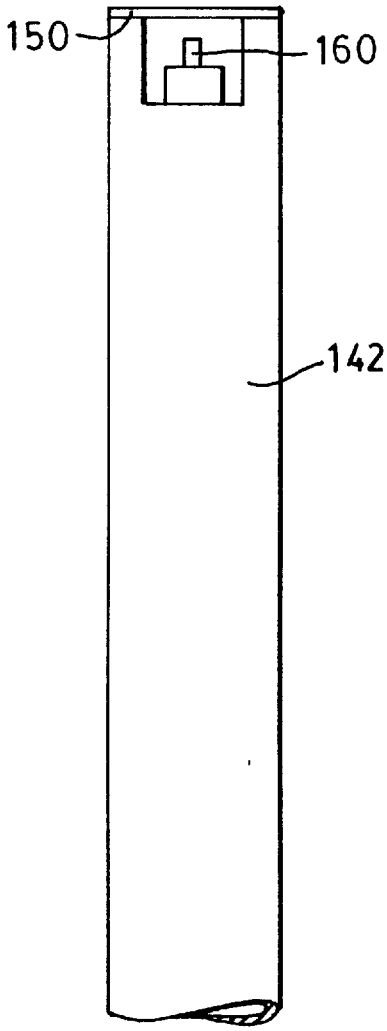
FIG. 24*a* is a close-up view of FIG. 23.

If fluctuations of gas flow volumes are not expected in the stripper 36, then the single spark gap version of the sparking pilot shown in FIGS. 23, 24*a* and 24*b* may be used instead. A difference with the single gap version is that the top end 150 of the housing 142 forms a solid plate (omitting aperture 162) and the electrode tip 160 is pointed (and not flat like 164).

The sparking pilot 140 of FIGS. 19–24*b* may also be installed with a thermocouple assembly 130 (as for pilot 40) to control sparking of the electrode 146.

Figure 25:
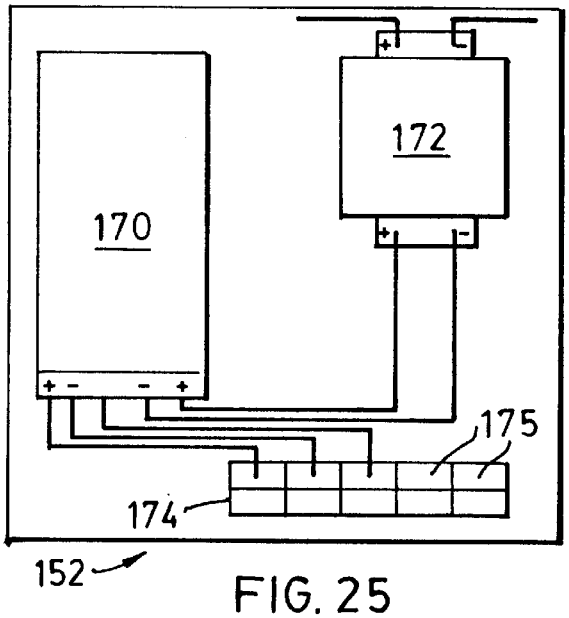
FIG. 25 is a schematic view of a control assembly for the ignition assemblies of FIGS. 19 and 23.

A detailed schematic view of the wiring in the conventional coil box 152 is shown in FIG. 25. The box typically has a high voltage transformer 170 for increasing the voltage from a low voltage power source (say 6–24 V) to about 12,000 V, and a booster 172 to further increase the voltage to about 20,000 V or more, as required. The transformer and booster are wired to a terminal strip 174 which has vacant spots 175 for use with other hardware, such as a thermocoupler, if provided. AC or DC power may be used from diverse sources such as solar panels or thermal generators. An advantage of locating the transformer on a pilot housing rather than at the power source (typically located away from the flare vent near ground level and communicating with the vent by a high voltage line) is the reduced risk of electric shock to anyone in the vicinity of the vent.

It can now be appreciated how the ignition assembly of the present invention functions and some of the resulting benefits. For illustrative purposes and ease of reference, the third embodiment of the flame pilot 40 (ie. the sensored auto-light version) will be referred to since it encompasses the most features. With the pilot, electrode and thermocouple assemblies fully mounted to the carrier 52 and in a lowered inoperative position, a technician engages the winch 54 to slide the assemblies along the channel 46 to an operative position within the stripper 36 in which the opening 100 of the pilot housing 42 is spaced from and just below the conduit 38. The winch is locked to maintain said operative position. The ignition assembly is then activated by opening up the fuel supply to the pilot 40 and by initiating the electrode and thermocouple assemblies 110 and 130, respectively. The electrode 112 should begin sparking right away since the sensor 132 of the thermocouple does not register any heat from a flame. When the fuel reaches the combustion chamber 90, the sparks should ignite the fuel, thereby creating the pilot flame at the open end 98 of the pilot housing. The sparking should stop at some point afterwards, depending on the chosen temperature control setting and the time it takes for the temperature at the sensor to reach that pre-set value. As the pilot flame bums it draws air through the stripper from the lower opening 72 which causes an intense high pitched whistling sound audible from hundreds of yards away from the stack. Since the pilot flame is normally obscured from view by the stripper, this sound indicates to a technician that the pilot flame is burning without actually having to visually inspect the pilot 40. The air drawn through the stripper also helps the pilot bum more cleanly and helps to cool the pilot, electrode and thermocouple assemblies within the stripper.

Since the pilot flame bums at the mouth of the conduit 38, gases entering the stripper through the conduit 38 ignite causing a larger "secondary" burn to take place at the upper opening 70 of the stripper. This bum is called the ignition flame because it in turn ignites the gases exiting the open terminal end 34 of the flare stack 32. As the ignition flame bums it also draws air through the stripper 36 for burning purposes. Hence, the ignition assembly 30 uses a portion of the waste gases from the flare stack to produce the ignition flame which in turn ignites the remaining gases exiting the stack. This arrangement contributes to the significantly lower fuel consumption of the flame pilot according to the present invention. Tests of the flame pilot have resulted in fuel (ie. propane) consumption of about 2.5 liters (about 3 US quarts) per day, as opposed to between 4 to 6 liters or more of propane for prior art ignitors.

The ignition assembly 30 provides a type of "fail-safe" ignition system for the stack. In all embodiments, should the flow of gases in the stack be interrupted for any reason, then the ignition flame will be extinguished but the pilot flame should continue to burn (ie. or to spark in the fourth embodiment). Upon resumption of gas flow up the stack, the ignition flame will be ignited again as noted above. Should the pilot stop functioning for any reason (e.g. no fuel or electricity), then the ignition flame should continue burning as long as there is sufficient gas flow through the conduit 38 from the stack. In all embodiments except for the first (manual relight), running out of fuel should not affect the ignition flame because the sparking of the electrodes should re-ignite the gases from the conduit 38 if the ignition flame is extinguished.

Another advantage of the present invention may now be better appreciated. The pilot housing 42 and the pilot therein should require less maintenance and replacement than existing ignitors because the housing and pilot are located some distance away (about 6 inches (aprox. 152 mm) in the preferred embodiment) from the main burn at the terminal end of the stack, which produces much more heat than the pilot flame or ignitor flame. Prior art ignitors are located right in or beside the main burn, which exposes the ignitor to intense heat and corrosive gases. In comparison, the pilot 40 (in particular the flame spreader 84) is kept below the flames and away from the gases exiting the terminal end of the flare stack. Even the gases flowing through the conduit 38 are introduced to the stripper above the pilot. Hence, the stainless steel and other materials of the ignition assembly 30 are less distressed than in other prior systems. In tests of the present invention, temperatures registered by the thermocouple adjacent the pilot 40 ranged between 120 degrees C to no more than 300 degrees C.

The flame pilot according to the present invention also does not require very high fuel pressure to function. Good pilot flames have been achieved with as little as 3 psi of propane pressure. Comparable prior art systems function on between 12 to 18 psi of pressure. This advantage is attributed in part to the configuration of the flame spreader 84 and the fuel line elbow connection 76 which has relatively few bends.

The above description is intended in an illustrative rather than a restrictive sense and variations to the specific configurations described may be apparent to skilled persons in adapting the present invention to specific applications. Such variations are intended to form part of the present invention insofar as they are within the spirit and scope of the claims below. For instance, a nipple may be located in the wall of the mixing chamber in pilot tube 83 below the flame spreader 84 to purge the tube of any fluid which might enter through the flame spreader and threaten to obstruct or hamper fuel flow to the combustion chamber 90.

We claim:

1. An ignition assembly for a flare vent having an open terminal end for venting waste gases comprising:

a stripper comprising a generally hollow tubular member located adjacent a generally upright exterior wall of said flare vent, said tubular member having a lower opening and an upper opening proximate to said terminal end of the flare vent;

a conduit for waste gas communication from said flare vent to said stripper, said conduit being located below both said upper opening of the stripper and said terminal end of the flare vent;

a pilot having an igniting end for igniting waste gases entering said stripper through said conduit to produce an ignition flame at said upper opening of the stripper, said ignition flame igniting waste gases exiting said terminal end of the flare vent, wherein said pilot comprises:

a fuel supply line for transporting fuel from a fuel source;

a venturi orifice in communication with said fuel supply line for introducing air to said fuel;

a mixing chamber for receiving said air and fuel from said venturi orifice, said mixing chamber being of sufficient length to allow adequate mixing of said air and fuel when passing through said mixing chamber;

a flame spreader for further mixing of said air and fuel mixture received from said mixing chamber and for creating a back pressure in said mixing chamber; and a combustion chamber for combusting said air and fuel mixture exiting said flame spreader to produce a pilot flame;

an elongate tubular housing for said pilot having an open top end for exposing said pilot igniting end to waste gases in the stripper, wherein said housing is insertable into said stripper and when inserted allows air flow through said stripper for producing said ignition flame and for cooling said top end of the housing; and a track attached to said exterior wall of the flare vent for moving said housing and pilot between an inoperative position near the base of said flare vent and an operative position near said terminal end of the flare vent, wherein in said operative position said first end of the housing and said pilot are located within said stripper below said conduit;

wherein in operation said combustion chamber is located below said top end of said pilot housing and said pilot flame ignites gases entering said stripper through said conduit to produce said ignition flame at said upper opening of the stripper.

2. The ignition assembly of claim 1 wherein an electrode assembly having a source of electric power is located adjacent said combustion chamber for providing sparks to initiate said combustion in the combustion chamber.

3. The ignition assembly of claim 2 wherein a thermocouple assembly having a control means is located adjacent said combustion chamber to control said sparking from the electrode assembly, said sparking being activated when the temperature in said combustion chamber falls below a first pre-set value, and said sparking being disengaged when said temperature exceeds a second pre-set value.

4. The ignition assembly of claim 1 wherein said flame spreader comprises at least two helical channels about a hub to spiral the flow of the air and fuel mixture passing therethrough from the mixing chamber to the combustion chamber.

5. The ignition assembly of claim 4 wherein the incline of said channels is between about 25 and 35 degrees to the longitudinal axis of said hub.

6. The ignition assembly of claim 5 wherein the length of said flame spreader along said longitudinal axis is between about 0.75 and 1.25 inches.

7. The ignition assembly of claim 6 wherein said flame spreader is about one inch in length and has two helical channels with an incline of about 30 degrees.

8. The ignition assembly of claim 1 wherein said pilot comprises an electrode assembly having a source of electric power for providing sparks to ignite said ignition flame, said electrode assembly comprising a first pair of electrodes wherein a first electrode connected to said source of electric power is spaced from a second grounded electrode to form a spark gap therebetween, said source being controlled to provide a spark across said spark gap at a preset frequency.

9. The ignition assembly of claim 8 wherein said sparking is controlled by a thermocouple assembly having a control means located in the vicinity of said ignition flame to control said sparking, said sparking being activated when the temperature of said pilot falls below a first pre-set value when said ignition flame is extinguished, and said sparking being deactivated when said temperature exceeds a second pre-set value.

10. The ignition assembly of claim 8 wherein said first electrode forms a generally pointed arcing surface which is oriented substantially perpendicular to said second electrode having a generally planar arcing surface, said first electrode being located below said second electrode when said electrode assembly is in said operative position.

11. The ignition assembly of claim 8 wherein said electrode assembly includes a second pair of electrodes located below said first pair of electrodes when said electrode assembly is in an operative position.

12. The ignition assembly of claim 11 wherein said pilot housing includes at least one opening adjacent said second pair of electrodes for exposure to said gases entering said stripper through said conduit.

13. The ignition assembly of claim 8 wherein said conduit penetrates said exterior wall of the flare vent and a sidewall of said tubular stripper, said conduit being inclined upwardly away from said exterior wall of the flare vent to direct waste gases away from said pilot housing when first exiting said conduit and to facilitate movement of waste gases from the flare vent to the stripper.

14. The ignition assembly of claim 13 wherein said conduit is spaced at least 4 inches below said upper opening of the stripper.

15. The ignition assembly of claim 13 wherein said incline forms an angle of about 45 degrees between said conduit and said exterior wall of the flare stack.

16. The ignition assembly of claim 13 wherein said stripper is inclined relative to said flare vent so that said pilot housing is positioned generally parallel to said stripper when in said operative position, said stripper being spaced from said exterior wall of the flare vent with the lower opening being spaced further from said exterior wall than the upper opening.

17. The ignition assembly of claim 16 wherein said lower opening of the stripper is flared outwardly to guide said pilot housing into the stripper upon insertion therein.

18. An ignition assembly for a flare vent having an open terminal end for venting waste gases comprising:

a stripper comprising a generally hollow tubular member located adjacent a generally upright exterior wall of said flare vent, said tubular member having a lower opening and an upper opening proximate to said terminal end of the flare vent;

a conduit for waste gas communication from said flare vent to said stripper, said conduit being located below both said upper opening of the stripper and said terminal end of the flare vent;

a pilot having an igniting end for igniting waste gases entering said stripper through said conduit to produce an ignition flame at said upper opening of the stripper, said ignition flame igniting waste gases exiting said terminal end of the flare vent;

an elongate tubular housing for said pilot having an open top end for exposing said pilot igniting end to waste gases in the stripper, wherein said housing is insertable into said stripper and when inserted allows air flow through said stripper for producing said ignition flame and for cooling said top end of the housing; and a track attached to said exterior wall of the flare vent for moving said housing and pilot between an inoperative position near the base of said flare vent and an operative position near said terminal end of the flare vent, wherein in said operative position said first end of the housing and said pilot are located within said stripper below said conduit;

wherein said conduit penetrates said exterior wall of the flare vent and a sidewall of said tubular stripper, said conduit being inclined upwardly away from said exterior wall of the flare vent to direct waste gases away from said pilot housing when first exiting said conduit and to facilitate movement of waste gases from the flare vent to the stripper.

19. The ignition assembly of claim 18 wherein said conduit is spaced at least 4 inches below said upper opening of the stripper.

20. The ignition assembly of claim 18 wherein said incline forms an angle of about 45 degrees from the horizontal.

21. The ignition assembly of claim 18 wherein said stripper is inclined relative to said flare vent so that said pilot housing is positioned generally parallel to said stripper when in said operative position, said stripper being spaced from said exterior wall of the flare vent with the lower opening being spaced further from said exterior wall than the upper opening.

22. The ignition assembly of claim 21 wherein said lower opening of the stripper is flared outwardly to guide said pilot housing into the stripper upon insertion therein.

23. The ignition assembly of claim 21 wherein said pilot housing and portions of said electrode assembly and thermocouple assembly are located side-by-side in said stripper and are sized so that air flowing through said stripper forms an audible whistle in the presence of said pilot flame to indicate that said pilot flame is burning.

24. An ignition assembly for a flare vent having an open terminal end for venting waste gases comprising:

a stripper comprising a generally hollow tubular member located adjacent a generally upright exterior wall of said flare vent, said tubular member having a lower opening and an upper opening proximate to said terminal end of the flare vent;

a conduit for waste gas communication from said flare vent to said stripper, said conduit being located below both said upper opening of the stripper and said terminal end of the flare vent;

a pilot having an igniting end for igniting waste gases entering said stripper through said conduit to produce an ignition flame at said upper opening of the stripper, said ignition flame igniting waste gases exiting said terminal end of the flare vent;

an elongate tubular housing for said pilot having an open top end for exposing said pilot igniting end to waste gases in the stripper, wherein said housing is insertable into said stripper and when inserted allows air flow through said stripper for producing said ignition flame and for cooling said top end of the housing; and a track attached to said exterior wall of the flare vent for moving said housing and pilot between an inoperative position near the base of said flare vent and an operative position near said terminal end of the flare vent, wherein in said operative position said first end of the housing and said pilot are located within said stripper below said conduit, and wherein said track comprises:

an elongate u-shaped channel extending generally vertically along the exterior wall of the flare vent;

a plurality of brackets for spacing the channel from said exterior wall and for supporting said channel on said exterior wall;

a carrier slideably mounted on said channel, said carrier having at least one lower arm to which a bottom end of said pilot housing is pivotally connected, and at least one upper arm for removably connecting an intermediate portion of said pilot housing to said carrier, wherein in said inoperative position said pilot housing may be detached from said carrier at said upper arm and pivoted about said lower arm for maintenance; and a pulley mounted adjacent each end of said channel, and a pulley cable running between said pulleys and attached to said carrier for raising and lowering said carrier.

25. The ignition assembly of claim 24 wherein said channel: is made of channel iron for mounting close to said exterior wall of the flare vent; is adapted to house said pulley cable and any other wires or cables of the ignition assembly extending along the exterior wall of the flare stack; and, is inclined at an upper portion thereof toward said flare vent to tip said pilot housing toward the terminal end of said flare vent in said operative position.

26. An ignition assembly for an upright flare vent having an open terminal end for venting waste gases comprising:

a generally elongate pilot having an igniting end;

a generally elongate sleeve housing said pilot, said sleeve having an open top end for exposing said igniting end to the ambient;

a hollow stripper mounted adjacent an exterior wall of said flare vent, said stripper having opposed upper and lower openings, said upper opening being located adjacent said terminal end of the flare vent;

an elongate tubular conduit located between said upper opening and said lower opening of the stripper for diverting a portion of said waste gases from said flare vent into said stripper, said diverted gases forming a stream upon exiting said conduit in said stripper, said conduit being inclined to said exterior wall of the flare vent to direct said stream of diverted gases above said open top end of the sleeve when first exiting said conduit; and, a track attached to said exterior wall of the flare vent for locating said igniting end of the pilot and said first end of the sleeve in said stripper in close proximity to said stream of waste gases from the conduit.

27. The ignition assembly of claim 26 wherein said stripper includes means for maintaining said igniting end of the pilot below a preset temperature.

28. The ignition assembly of claim 27 wherein said maintaining means comprises a space between said stripper and said sleeve for allowing air flow from said lower opening of the stripper to said end of the sleeve for cooling said igniting end of the pilot and said sleeve.

29. The ignition assembly of claim 28 wherein said maintaining means further comprises locating said lower opening of the stripper a sufficient distance from said upper opening and from said igniting end of the pilot to avoid the intake of air heated by a flare at the terminal end of the vent into said lower opening.

30. The ignition assembly of claim 29 wherein said lower opening is located at least three feet from said igniting end of the pilot when inserted in said stripper.

31. The ignition assembly of claim 26 wherein said stripper is spaced from and inclined to said exterior wall of the flare vent.

* * * * *